US009322234B2

(12) United States Patent
Deere et al.

(10) Patent No.: US 9,322,234 B2
(45) **Date of Patent: *Apr. 26, 2016**

(54) SYSTEM FOR COUPLING MWD TOOLS

(71) Applicant: TOLTEQ GROUP, LLC, Cedar Park, TX (US)

(72) Inventors: R. Paul Deere, Cedar Park, TX (US); Abraham Gonzalez, Cedar Park, TX (US)

(73) Assignee: TOLTEQ GROUP, LLC, Cedar Park, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/525,281

(22) Filed: Oct. 28, 2014

(65) Prior Publication Data

US 2015/0041149 A1 Feb. 12, 2015

Related U.S. Application Data

(63) Continuation of application No. 13/184,143, filed on Jul. 15, 2011, now Pat. No. 8,869,887.

(60) Provisional application No. 61/504,847, filed on Jul. 6, 2011.

(51) Int. Cl.

| | |
|---|---|
| ***E21B 17/00*** | (2006.01) |
| ***E21B 23/00*** | (2006.01) |
| ***E21B 17/02*** | (2006.01) |
| ***E21B 33/038*** | (2006.01) |
| ***E21B 17/10*** | (2006.01) |
| ***H01R 13/64*** | (2006.01) |
| ***E21B 47/00*** | (2012.01) |
| *H01R 13/533* | (2006.01) |

(52) U.S. Cl.

CPC ..... *E21B 23/00* (2013.01); *E21B 17/028* (2013.01); *E21B 17/10* (2013.01); *E21B 33/0385* (2013.01); *E21B 47/00* (2013.01); *H01R 13/64* (2013.01); *H01R 13/533* (2013.01)

(58) Field of Classification Search

CPC ..... E21B 17/003; E21B 17/028; E21B 17/07
USPC ..... 166/242.6, 242.7, 65.1; 439/131, 191, 439/192, 194, 195, 21

See application file for complete search history.

(56) References Cited

U.S. PATENT DOCUMENTS 5,334,801 A * 8/1994 Mohn ..... 174/47
5,389,003 A * 2/1995 Van Steenwyk et al. ..... 439/191

(Continued)

*Primary Examiner* — Robert E Fuller
*Assistant Examiner* — David Carroll
(74) *Attorney, Agent, or Firm* — Strasburger & Price, LLP

(57) ABSTRACT

Downhole tools, such as MWD modules (or components), may be coupled together with a coupler (or coupling device) having a shall housing with slidable electrical connectors disposed at each end. The electrical connectors may each be supported in connector housings disposed with springs or other movable devices. In a first position, the electrical connectors may extend past the ends of the shaft housing. The slidable connector housings allow the electrical connections to be made before the sleeves connecting (or mechanically connecting) the MWD modules with the coupler are begun to be threadedly attached with the coupler. Each of the connector housings may have a key configuration on their exposed end. The shaft housing may also have key configurations on its ends. The key configurations of the connector housings and the shaft housing may be configured to mate with compatible ends of MWD modules.

8 Claims, 14 Drawing Sheets

(56) References Cited

U.S. PATENT DOCUMENTS

| | | | | |
|---|---|---|---|---|
| 6,481,495 | B1 * | 11/2002 | Evans | 166/65.1 |
| 6,655,464 | B2 * | 12/2003 | Chau et al. | 166/380 |
| 7,074,064 | B2 * | 7/2006 | Wallace | 439/190 |
| 7,213,655 | B2 * | 5/2007 | Parrott | 166/380 |
| 7,488,194 | B2 * | 2/2009 | Hall et al. | 439/191 |
| 7,543,659 | B2 * | 6/2009 | Partouche et al. | 175/320 |
| 7,566,235 | B2 * | 7/2009 | Bottos et al. | 439/191 |
| 7,649,475 | B2 * | 1/2010 | Hall et al. | 340/854.9 |
| 7,980,874 | B2 * | 7/2011 | Finke et al. | 439/194 |
| 8,225,865 | B2 * | 7/2012 | Robert et al. | 166/242.6 |
| 8,544,553 | B2 * | 10/2013 | Milkovisch et al. | 166/378 |
| 8,627,901 | B1 * | 1/2014 | Underwood et al. | 175/16 |
| 8,869,887 | B2 * | 10/2014 | Deere et al. | 166/242.7 |
| 2005/0205304 | A1 * | 9/2005 | Gurjar et al. | 175/75 |
| 2011/0235981 | A1 * | 9/2011 | Guven et al. | 385/95 |

* cited by examiner

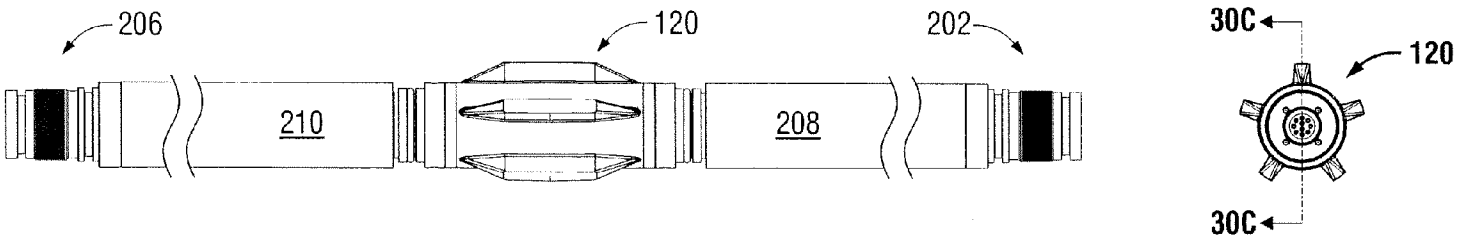
FIG. 30A
FIG. 30
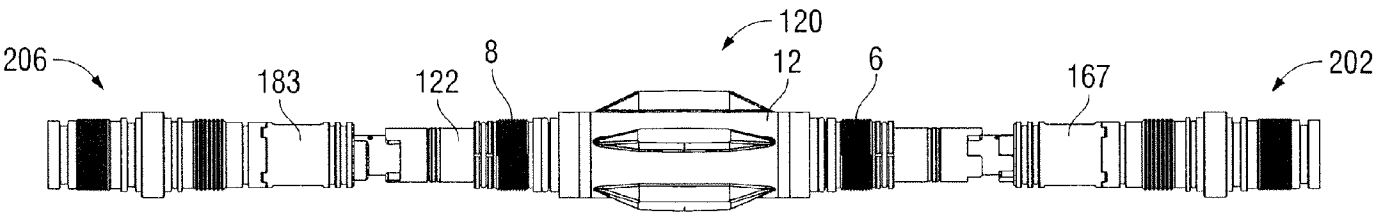
FIG. 30B
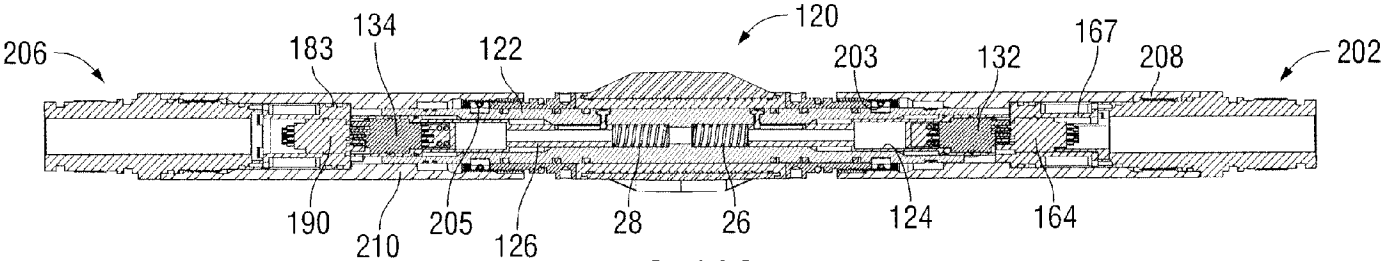
FIG. 30C

SYSTEM FOR COUPLING MWD TOOLS

CROSS-REFERENCE TO RELATED APPLICATIONS

This application is a continuation application that claims the benefit of U.S. Non-Provisional application Ser. No. 13/184,143, filed on Jul. 15, 2011, issued under U.S. Pat. No. 8,869,887 on Oct. 28, 2014 which claims the benefit of Provisional Application No. 61/504,847 filed on Jul. 6, 2011, which, are hereby incorporated by reference for all purposes in their entirety.

STATEMENT REGARDING FEDERALLY SPONSORED RESEARCH OR DEVELOPMENT

N/A

REFERENCE TO MICROFICHE APPENDIX

N/A

BACKGROUND OF THE INVENTION

1. Field of the Invention

This invention relates to the field of downhole tools, measurement while drilling modules, centralizers and components.

2. Description of the Related Art

Downhole tools are used in drilling and production. Downhole tools include, among others, wireline logging tools, production logging tools, and tools that take measurements while drilling, such as measurement while drilling (MWD) tools, logging while drilling (LWD) tools, and survey while drilling (SWD) tools. Downhole took are typically comprised of different modules coupled together. The coupling mechanism is sometimes integrated in the modules but typically the coupling mechanism is a separate device that also serves the function of centralizing the tool string in the drill collars or drill pipe. MWD tool strings are positioned downhole it a well to take measurements and convey the information to the surface. Examples of MWD modules include pulser modules, sensor modules, and battery modules, among others. A prior art MWD centralizer, shown in FIG. 1, is connected between two MWD modules to keep them centered in the well during the drilling process. The centralizer has electrical connectors at both ends to mate with matching electrical connectors on the ends of the MWD modules. Both the electrical connectors on the centralizer and the MWD modules have a combination of electrical pins and sockets for mating with each other. Different electrical connectors (that is, different electrical pin and socket configurations) are typically used on the two ends of the centralizer, but both ends of the centralizer have similar half-circular key configurations.

The industry standard is to have a four (4) electrical pin, six (6) socket electrical connector profile oriented vertically or at 90 degrees on the down-hole end of the centralizer, as shown on the right side of FIG. 1, and a six (6) electrical pin, four (4) socket electrical connector profile oriented at 45 degrees on the up-hole end of the centralizer, as shown on the left side of FIG. 1. The industry standard is to have a six (6) electrical pin, four (4) socket electrical connector profile oriented vertically or at 90 degrees on the up-hole end of the MWD module, and a four (4) pin, six (6) socket electrical connector profile oriented at 45 degrees on the down-hole end of the MWD module.

A tubular sleeve or pressure housing with internal threads at both ends is threadedly attached to both the MWD module and the centralizer to cover the electrical connection and protect it from the pressures in the well. Before the electrical connection can be made, the sleeve has to be threadedly attached to both the MWD module and the centralizer. The sleeve is usually first attached to the MWD module. After the sleeve is secured to the MWD module, the sleeve extends several inches past the electrical connector on the end of the MWD module, making the electrical connector difficult to access and see.

As shown in FIG. 2A, the electrical connectors on both ends of the centralizer are flush with the ends of the centralizer. Due to the configuration of the prior art centralizer, the threaded connection between the sleeve and the centralizer must be started and nearly completed before an electrical connection (e.g., pins of a connector electrically engaging the sockets of another connector) between the centralizer and the MWD module is made. The electrical connection is made "blind" in that the electrical connectors cannot be seen when the centralizer is being threadedly attached with the sleeve since the electrical connectors are covered by the sleeve. In addition, the electrical connection between the MWD module and the centralizer has to be made with more force than would otherwise be necessary since it must be made while threadingly attaching the sleeve with the centralizer.

The method and system of the past have several disadvantages. Since the key configurations on both ends of the centralizer are similar half-circular shapes, and since the electrical connector on the end of the MWD module is shielded by the sleeve and is difficult to see, it is common for the ends of the centralizer to be mistakenly reversed. An end of the centralizer with an incompatible electrical connector may be mistakenly threadedly attached with the sleeve of the MWD module, resulting in damage to the electrical pins of the electrical connectors, with the resulting costly repairs and delay. This is a common problem when dealing with components in the field where environmental conditions can be severe. Damage to the MWD module internal electronics may also occur.

Even if the correct end of centralizer is connected to the sleeve, the process is still time consuming. Initially, it takes time to insure that the centralizer is oriented correctly. Also, since the threaded physical connection between the centralizer and the sleeve has to be made before the electrical connection, the threaded connection has to be done slowly to insure that the electrical connectors, which cannot be seen due to the sleeve, align and mate. It is common for the threaded connection to be tightened, but the electrical connectors to not be electrically connected or coupled. In such a situation, the threaded connection has to be reversed a certain amount, and the inner housing of the centralizer that supports the electrical connector manually manipulated such as by twisting and pushing to insure the electrical connection is made, at which point the threaded connection has to be retightened. The determination of whether the electrical connection has been made properly is done by feel, which depends on the experience and training of the MWD operator.

It is also common to have the half-circular keys of the centralizer and MWD module almost aligned, and when the threaded connection begins to be made, the corners of both keys contact each other. When the threaded connection is continued to be made under such a condition, the corners of the electrical connectors often break. The disadvantages of the past have plagued the MWD industry for at least twenty years.

A need exists for a method and system to connect MWD modules with a device that prevents damage to the electrical connectors and saves time. A need also exists for a method and system to connect other downhole tools in addition to MWD modules.

BRIEF SUMMARY OF THE INVENTION

Electrical connectors may be slidably disposed at one end or at each end of a shaft housing of a coupler. The electrical connectors may be independently movable in relation to the shaft housing. In a first position, the electrical connectors may extend outwardly away from the respective ends of the shaft housing for electrical connection with MWD modules or tools before connection of the sleeve to the coupler. Connector housings may support the electrical connectors. In one embodiment, each connector housing is positioned with a spring in the shaft housing. The exposed ends of the connector housings and their supported electrical connectors protrude past the ends of the shaft housing when the springs are in their uncompressed condition, which allows the electrical connections to the MWD modules to be made before the sleeves connected with the MWD modules are threadedly attached with the coupler. While the threaded physical connection between the MWD modules and coupler housing are being made, the springs may compress and allow the connector housings and their supported electrical connectors to move inwardly (or slidably move) toward the center of the coupler to a second position.

The shaft housing may have key configurations on each of its ends. The connector housings may have key configurations on their exposed ends. In one embodiment, the key configurations on the ends of the shaft housing are the same, and the key configurations on the connector housings are the same. The key configurations may be half-circular shaped to mate with the ends of current MWD modules. In another embodiment, the key configurations on the ends of the shaft housing are different, and the key configurations on the ends of the connector housings are different. The key configuration on one connector housing and its end of the shaft housing may have two legs, and the key configuration on the other connector housing and its end of the shaft housing may have three legs. The connector housings and the shaft housing may be configured to mate with the ends of MWD modules having compatible key configurations to insure that the electrical connectors match and that the electrical pins are correctly aligned with sockets to prevent damage. The coupler may be used with different downhole tools.

BRIEF DESCRIPTION OF THE DRAWINGS

A better understanding of the present invention can be obtained with the following detailed descriptions of the various disclosed embodiments in the drawings, which are given by way of illustration only, and thus are not limiting the present invention, and wherein:

FIG. 30 is a side view of the coupler of FIG. 19 disposed between two MWD modules each having a sleeve for threaded attachment with the coupler, with the electrical connections between the coupler and both MWD modules having been made, but the sleeves not yet threadedly attached with the coupler.

FIG. 30A is an end view of the coupler and MWD module on the left side of FIG. 30.

FIG. 30B is the same view as FIG. 30 except without break lines and with the sleeves removed for clarity to show the keyed connection between the first connector housing and the MWD module on the right side, and the keyed connection between the second connector housing and the MWD module on the left side.

FIG. 30C is a cross-sectional view along line 30C-30C of FIG. 30A with the springs in their uncompressed condition, the electrical connection between the coupler and the MWD modules having been made, but the threaded connection with the two sleeves not having been made.

DETAILED DESCRIPTION OF THE INVENTION

Figure 1:
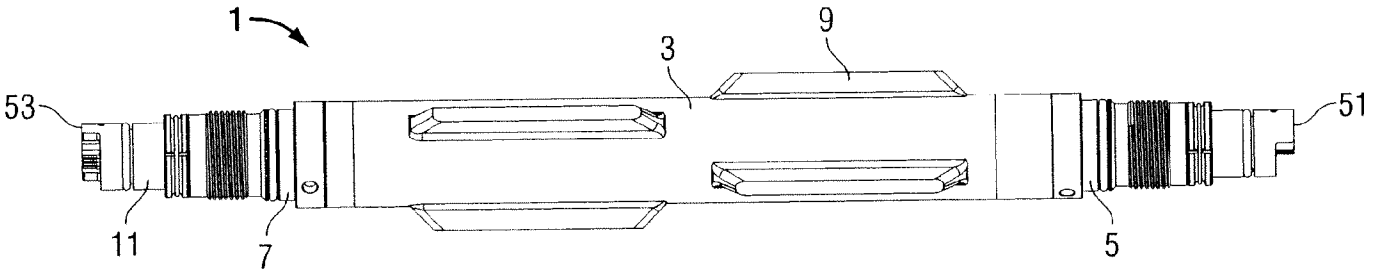
FIG. 1 (Prior Art)
FIG. 1 is a side view of a prior art centralizer.
Figure 2A:
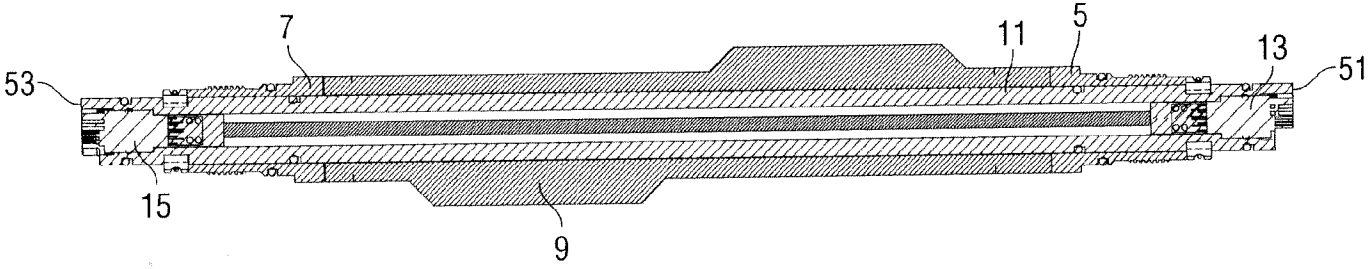
FIG. 2A (Prior Art)
FIG. 2A is a section view along line 2A-2A of FIG. 2 of the centralizer with a first electrical connector on the right side and a second electrical connector on the left side.
Figure 2:
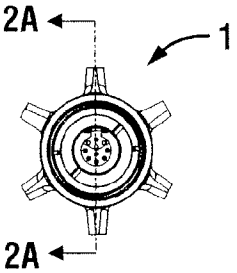
FIG. 2 (Prior Art)
FIG. 2 is an end view of the centralizer of FIG. 1.

In FIGS. 1 to 2A, prior art centralizer 1 has outer housing 3 with stabilizing fins 9. An inner housing 11 has a first electrical connector 13 flush with its first end 51 and a second electrical connector 15 flush with its second end 53. The outer housing 3 has adjacent threaded rings 5, 7 for threadedly attaching with sleeves from MWD modules (not shown). The threaded rings 5, 7 each rotate independently of the outer housing 3 and the inner housing 11. The inner housing 11 can be independently rotated within outer housing 3. The first and second ends 51, 53 of the inner housing 11 each have a half-circular key configuration, but the key configurations are oriented at an angle from each other about a horizontal axis through the inner housing 11.

Figure 3:
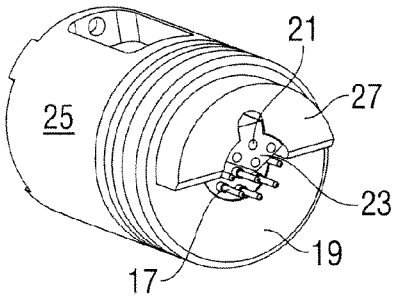
FIG. 3 (Prior Art)
FIG. 3 is an isometric view of a prior art MWD module end compatible with the first electrical connector on the right side of FIG. 2A.
Figure 4:
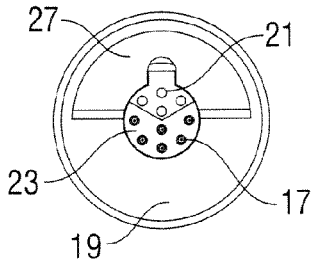
FIG. 4 (Prior Art)
FIG. 4 is an end view of FIG. 3.
Figure 5:
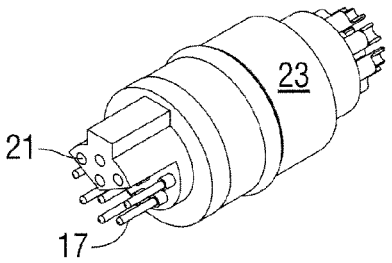
FIG. 5 (Prior Art)
FIG. 5 is an isometric view of the prior art electrical connector of FIG. 3.

Turning to FIGS. 3 and 4, prior art MWD module end 25 has an end surface 19 with a half circular protrusion 27 and supports an electrical connector 23 with six electrical pins 17 and four sockets 21. The body of the MWD module is not shown for clarity, and the sleeve that would shield the end 19 and electrical connector 23 is also not shown for clarity. The key configuration on the first end 51 of inner housing 11 of FIG. 2A and the supported first electrical connector 13 are compatible for mating with the end 19 and electrical connector 23 in FIGS. 3 and 4. MWD module electrical connector 23 is shown in isolation in FIG. 5.

Figure 6:
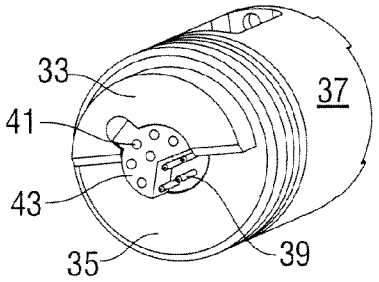
FIG. 6 (Prior Art)
FIG. 6 is an isometric view of a prior art MWD module end compatible with the second electrical connector on the left side of FIG. 2A.
Figure 7:
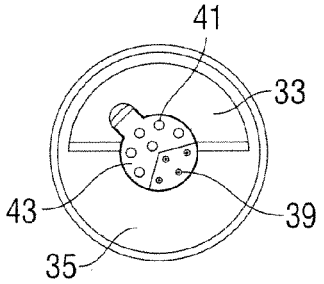
FIG. 7 (Prior Art)
FIG. 7 is an end view of FIG. 6.
Figure 8:
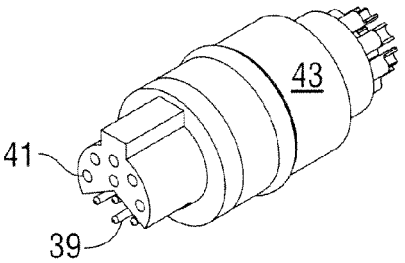
FIG. 8 (Prior Art)
FIG. 8 is an isometric view of the prior art electrical connector of FIG. 6.
Figure 10:
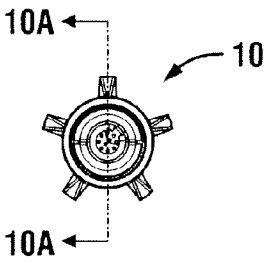
FIG. 10 is an end view of the coupler of FIG. 9.

In FIGS. 6 and 7, the prior art MWD module end 37 of a MWD module having an end surface 35 with half circular protrusion 33 supports an electrical connector 43 with four electrical pins 39 and six sockets 41. The body of the MWD module is not shown for clarity, and the sleeve that would shield the end 35 and electrical connector 43 is also not shown for clarity. The key configuration on the second end 53 of inner housing 11 of FIG. 2A and the supported second electrical connector 15 are compatible for mating with the end 35 in FIGS. 6 and 7. Electrical connector 43 in FIGS. 6-7 is rotated from alignment with a vertical axis. The angle from vertical is typically 45 degrees. MWD module electrical connector 43 is shown in isolation in FIG. 8.

As can now be understood, since the first and second electrical connectors 13, 15 are flush with the respective ends 51, 53 of the inner housing 11, the electrical connection with the MWD modules has to be made after the sleeves of the MWD modules are nearly completely threadedly attached with the respective threaded rings 5, 7 of the centralizer 1. Additionally, since the key configurations on the first and second ends 51, 53 of the inner housing 11 are both half-circular shaped, and the electrical connectors on the ends of the MWD modules are shielded by the sleeves, it is easy to mistakenly attempt to connect an end of the centralizer with an incompatible end of a MWD module. For example, if first end 51 of centralizer 1 is attempted to be connected with MWD module end 37 of FIG. 6, then the half-circular keys on both the centralizer and the MWD module will allow the threaded connection with the sleeve to be made (or mate), and as a result the incompatible electrical connectors will become damaged, such as by the electrical pins of both being bent or broken.

Figure 9:
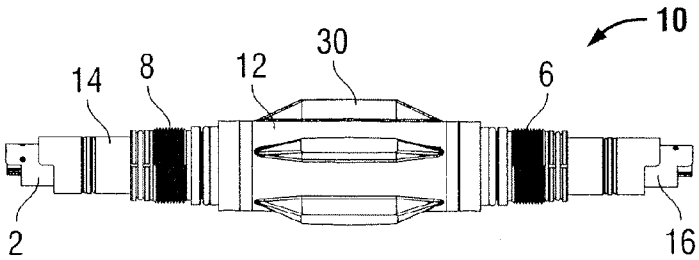
FIG. 9 is a side view of a coupler having a fin housing, a first connector housing protruding on the right side from a shaft housing, and a second connector housing protruding on the left side from the shaft housing.
Figure 10A:
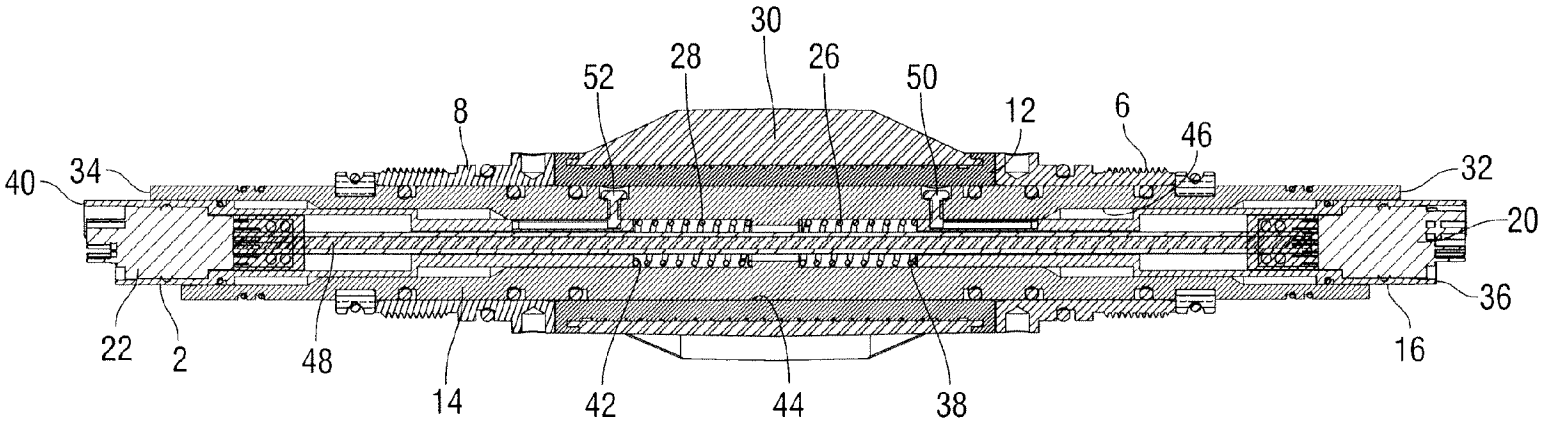
FIG. 10A is a section view along line 10A-10A of FIG. 10 with the shaft housing disposed in the thru bore of the fin housing, the first connector housing protruding on the right side from the shaft housing, the second connector housing protruding on the left side from the shaft housing, the unexposed ends of each connector housing each positioned with a spring in the shaft housing thru bore, and each connector housing supporting an electrical connector.
Figure 16:
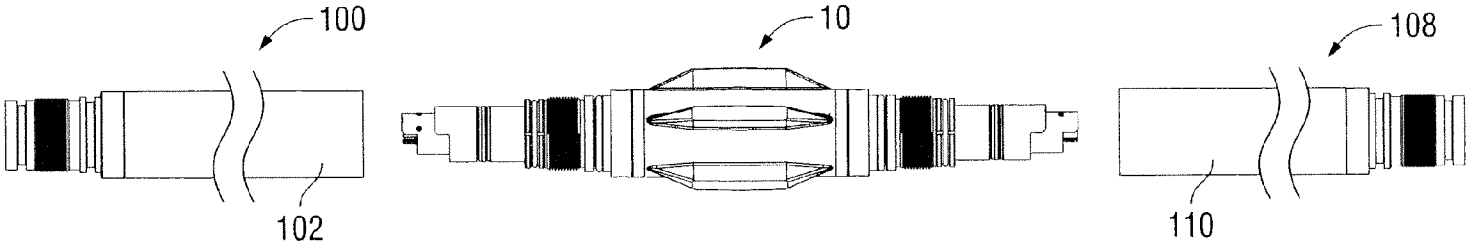
FIG. 16 is a side view of the coupler of FIG. 9 disposed between two MWD modules each having a sleeve or pressure housing for threaded attachment with the coupler.
Figure 16A:
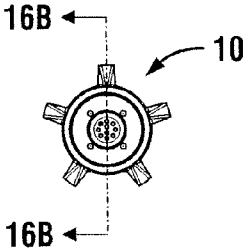
FIG. 16A is an end view of the coupler and MWD module on the left side of FIG. 16.
Figure 16B:
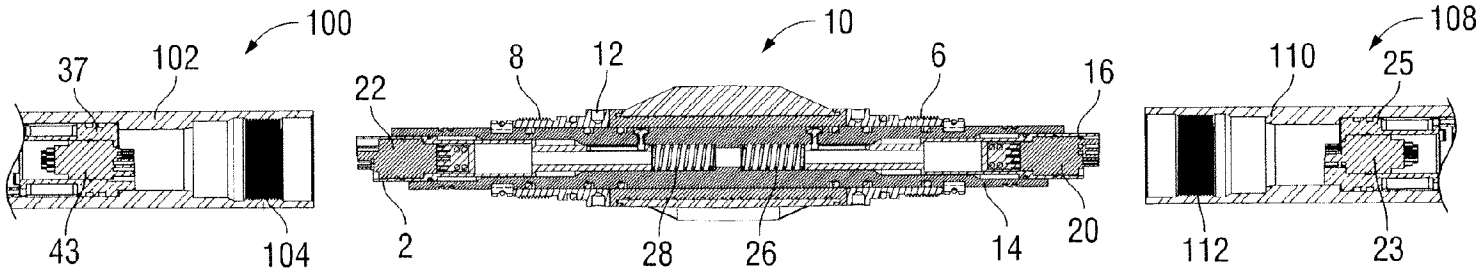
FIG. 16B is a cross-sectional view along line 16B-16B of FIG. 16A, with the electrical line through the shaft housing between the electrical connectors removed for clarity.

Turning to FIG. 9, coupler 10 may have fin housing 12 with stabilizing fins 30, shaft housing 14, first connector housing 16, and second connector housing 2. Fin housing 12 has adjacent first threaded ring 6 and second threaded ring 8. It is also contemplated that there may be no fin housing 12 or fins 30. The threaded rings 6, 8 each rotate independently of the fin housing 12 and the shaft housing 14. Sleeves from the MWD modules that are to be coupled with the coupler 10 are threadedly attached with the threaded rings 6, 8. Sleeves are shown in FIGS. 16 and 16B. As shown in FIG. 10A, shaft housing 14 is disposed in thru bore 44 of fin housing 12. The shaft housing 14 can be independently rotated within fin housing 12. First connector housing 16 is positioned in first end 32 of shaft housing 14 in the shaft housing thru bore 46. First electrical connector 20 is supported at the first or exposed end 36 of first connector housing 16. Second connector housing 2 is positioned in second end 34 of shaft housing 14 in the shaft housing thru bore 46. Second electrical connector 22 is supported at the first or exposed end 40 of second connector housing 2. First electrical connector 20 is in electrical communication with second electrical connector 22 through electrical line 48.

First spring 26 is positioned with the second or unexposed end 38 of first connector housing 16. Second spring 28 is positioned with the second or unexposed end 42 of second connector housing 2. Both springs 26, 28 are in their first or uncompressed condition, in which condition the respective exposed ends 36, 40 of the respective connector housings 16, 2 and their respective electrical connectors 20, 22 protrude outwardly away from the respective ends 32, 34 of the shaft housing 14. Pins 50, 52 in respective slots of respective connector housings 16, 2 limit the movement of the connector housings 16, 2 as the springs 26, 28 become compressed or uncompressed. Pins 50, 52 may be screws. Other means of slidably disposing the first and second electrical connectors 20, 22 with the coupler 10 are contemplated.

Figure 11:
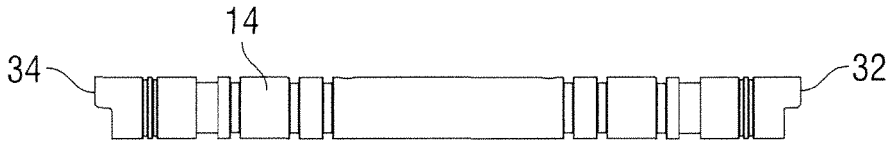
FIG. 11 is a side view of the shaft housing of FIG. 9.
Figure 11A:
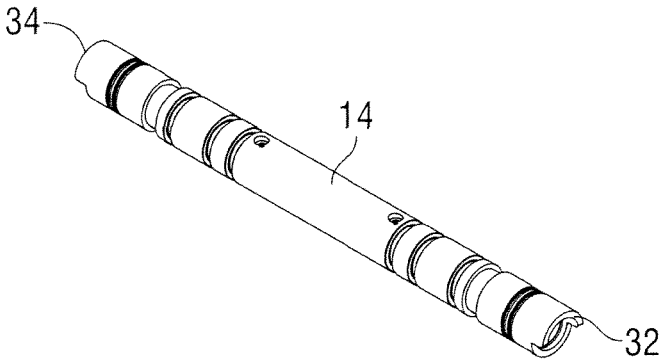
FIG. 11A is an isometric view of the shaft housing of FIG. 11 having a half circular key configuration on its first end and on its second end.
Figure 12:
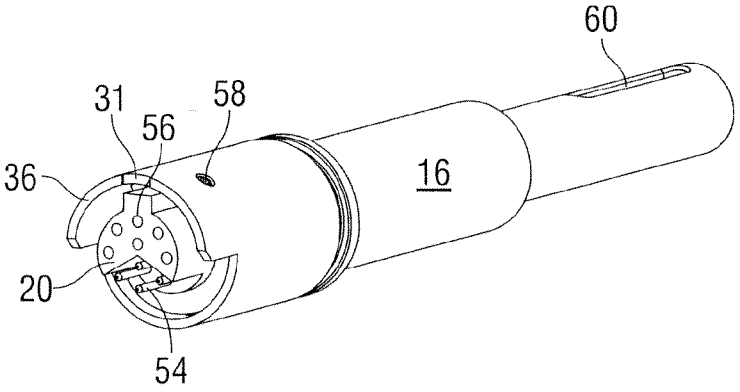
FIG. 12 is an isometric view of the first connector housing of FIG. 9 having a half circular key configuration on its first or exposed end and supporting a first electrical connector.
Figure 13:
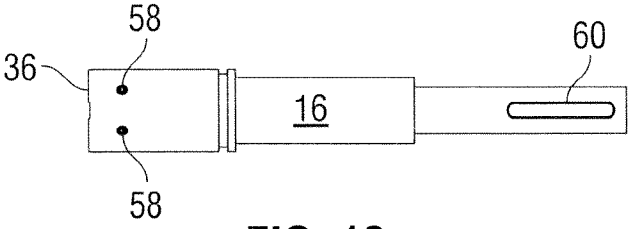
FIG. 13 is top view of the first connector housing of FIG. 12.

In FIGS. 11 and 11A, the first end 32 and second end 34 of shaft housing 14 have an identical key configuration, which is a half circular protrusion. The key configurations on the ends of shaft housing 14 are compatible with the prior art ends of MWD modules, such as the MWD module ends 25, 37 in FIGS. 3-4 and 6-7. In FIGS. 12 and 13, first electrical connector 20 is supported in first connector housing 16 and has four electrical pins 54 and six sockets 56. First electrical connector 20 is similar to the electrical connector 43 in FIG. 8. First electrical connector 20 is supported against a shoulder in first connector housing 16, and may be held in place with screws in holes 58. First electrical connector 20 is aligned along a vertical axis passing through notch 31. Pin 50 in FIG. 10A may be disposed in slot 60. First connector housing 16 and first electrical connector 20 are configured for mating with MWD module end 25 in FIGS. 3-4.

Figure 14:
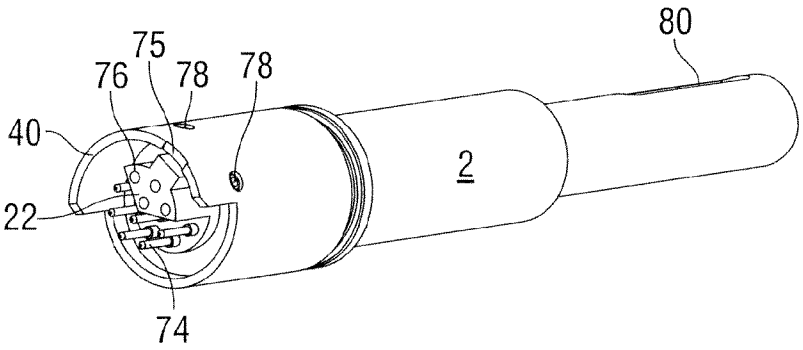
FIG. 14 is an isometric view of the second connector housing of FIG. 9 having a half circular key configuration on its first or exposed end and supporting a second electrical connector.
Figure 15:
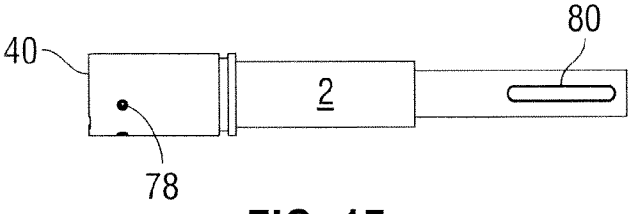
FIG. 15 is top view of the second connector housing of FIG. 14.

In FIGS. 14 and 15, second connector housing 2 supports second electrical connector 22 having six electrical pins 74 and four sockets 76. Second electrical connector 22 is supported against a shoulder in second connector housing 2, and may be held in place with screws in holes 78. Pin 52 in FIG. 2A may be disposed in slot 80. Second connector housing 2 has a similar half-circular key configuration as first connector housing 16. Second electrical connector 22 in FIG. 14 is rotated from alignment with a vertical axis. The angle from vertical is typically 45 degrees. Second electrical connector 22 is in alignment with an axis passing through notch 75. The holes 78 are also rotated from the position of holes 58 in FIGS. 12-13. Second electrical connector 22 is similar to the electrical connector 23 in FIG. 5. Second connector housing 2 and second electrical connector 22 are configured for mating with MWD module end 37 in FIGS. 6-7.

Turning to FIG. 16-16B, coupler 10 of FIG. 9 is positioned between first MWD module 108 and second MWD module 100, which modules are both only shown partially for clarity. First MWD module 108 has module end 25 shown in FIGS. 3-4, and second MWD module 100 has module end 37 shown in FIGS. 6-7. Since first connector housing 16 and first electrical connector 20 protrude from the first end of shaft housing 14, first electrical connector 20 may be aligned and connected with corresponding first module electrical connector 23, which is shown in detail in FIGS. 3-4, before first module sleeve or pressure housing 110 is begun to be threadedly attached with threads 112 to first threaded ring 6 on fin housing 12. This advantageously allows the electrical connection to be made before the threaded connection with the sleeve is started to minimize damage to the electrical pins on both the electrical connectors 20, 23. First spring 26 and second spring 28 are uncompressed and in their first positions. The electrical conduit between the first and second electrical connectors 20, 22 in FIG. 16B has been removed for clarity.

Similarly, since second connector housing 2 and second electrical connector 22 protrude from the second end of shaft housing 14, second electrical connector 22 may be aligned and connected with corresponding second module electrical connector 43, which is shown in detail in FIGS. 6-7, before second module sleeve or pressure housing 102 is begun to be threadedly attached with threads 104 to second threaded ring 8 on fin housing 12. This also advantageously allows the electrical connection to be made before the threaded connection with the sleeve is started to minimize damage to the electrical pins on both the electrical connectors 22, 43.

Figure 17A:
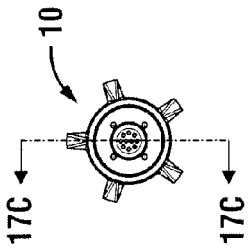
FIG. 17A is an end view of the coupler and MWD module on the left side of FIG. 17.
Figure 17:
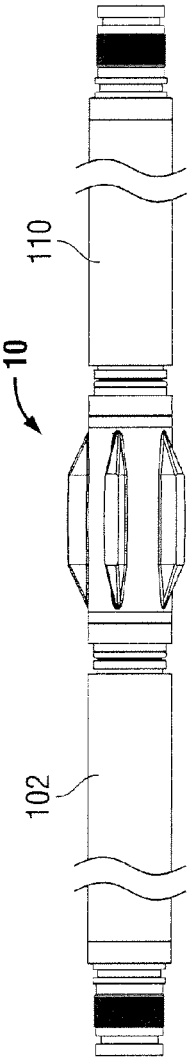
FIG. 17 is a side view of the coupler of FIG. 16 with the electrical connections between the coupler and both MWD modules having been made, but the sleeves not yet threadedly attached with the coupler.
Figure 17B:
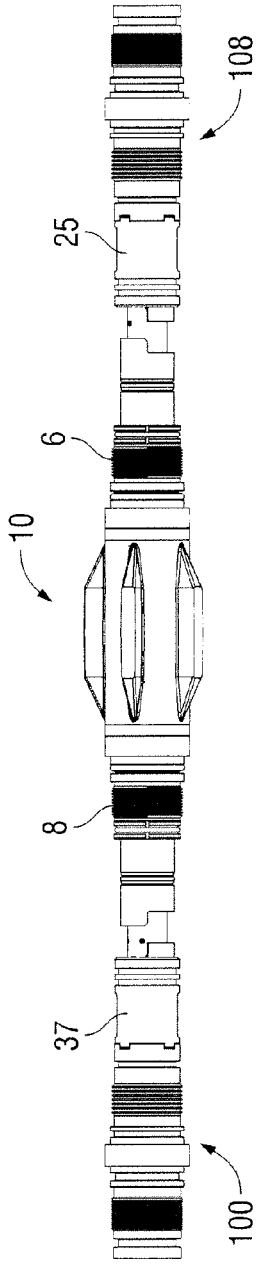
FIG. 17B is the same view as FIG. 17 except without break lines and with the sleeves removed for clarity to show the keyed connection between the first connector housing and the MWD module on the right side, and the keyed connection between the second connector housing and the MWD module on the left side.
Figure 17C:
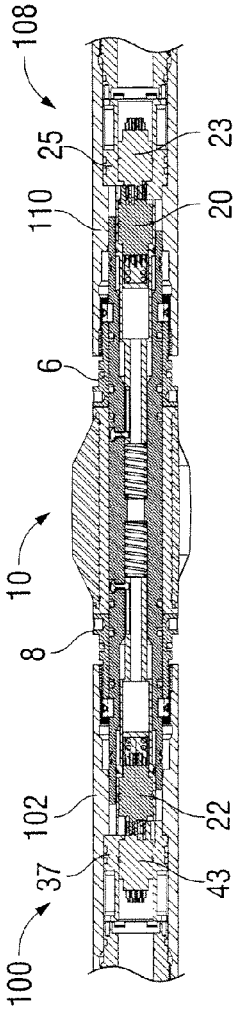
FIG. 17C is a cross-sectional view along line 17C-17C of FIG. 17A with the springs in their uncompressed condition, the electrical connection between the coupler and the MWD modules having been made, but the threaded connections with the two sleeves not having been made.

In FIG. 17-17C, the electrical connection between first electrical connector 20 and the electrical connector 23 on first MWD module 108 has been made, but first module sleeve 110 has not begun to be threadedly attached with first threaded ring 6 of coupler 10. Similarly, the electrical connection between second electrical connector 22 and the electrical connector 43 of second MWD module 100 has been made, but second module sleeve 102 has not been threadedly attached with second threaded ring 8 of coupler connector 10.

Figure 18A:
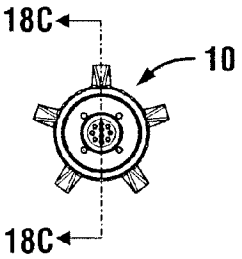
FIG. 18A is an end view of the coupler and MWD module on the left side of FIG. 18.
Figure 18:
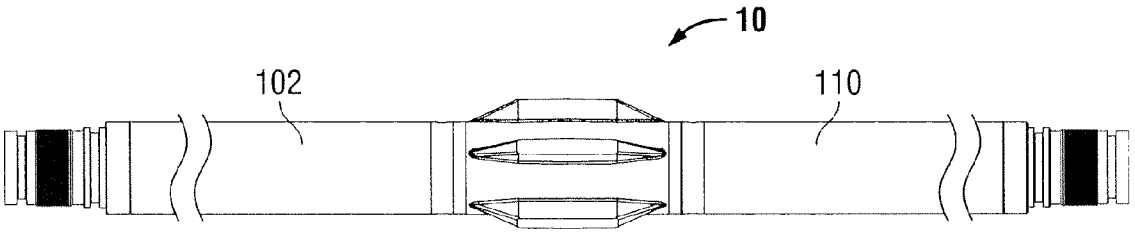
FIG. 18 is a side view of the coupler of FIG. 17 with the sleeves having been threadedly attached with the coupler and the connection with the two MWD modules completed.
Figure 18B:
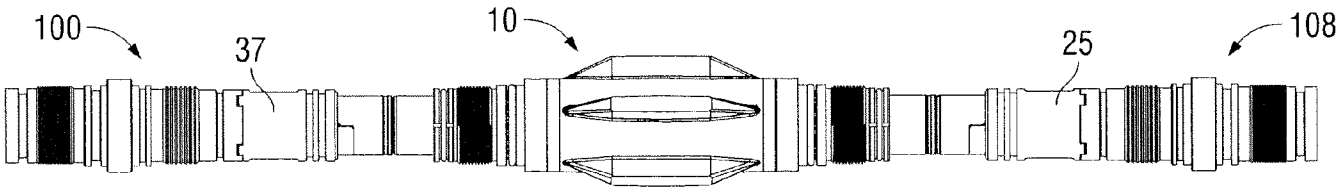
FIG. 18B is the same view as FIG. 18 except without break lines and with the sleeves removed for clarity to show the keyed connection between the shaft housing and the MWD module on the right side, and the keyed connection between the shaft housing and the MWD module on the left side.
Figure 18C:
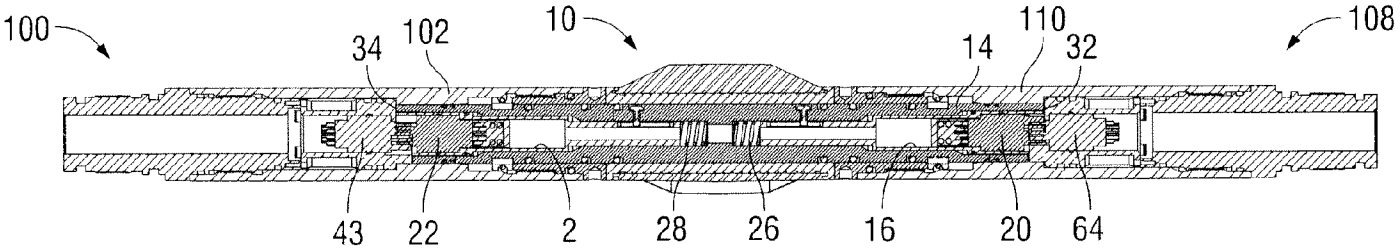
FIG. 18C is a cross-sectional view along line 18C-18C of FIG. 18A with the springs in their compressed condition, the electrical connection between the coupler connector and the MWD modules having been made, and the threaded connection with the sleeves having been made.
Figure 20:
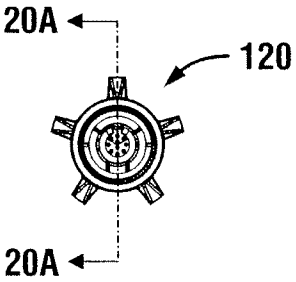
FIG. 20 is an end view of the coupler of FIG. 19.

In FIGS. 18-18C, coupler 10, first MWD module 108, and second MWD module 100 are in their fully coupled condition. First module sleeve 110 and second module sleeve 102 have been threadedly attached with coupler 10. First spring 26 and second spring 28 are in their compressed condition or second positions. During the connection of the sleeves 110, 102 with the coupler 10, first connector housing 16 and second connector housing 2 moved inwardly from their positions in FIG. 16, so that the exposed end 36 of first electrical connector 20 is flush with first end 32 of shaft housing 14, and the exposed end 40 of second electrical connector 22 is flush with second end 34 of shaft housing 14. The novel system and method of electrically connecting the coupler and the MWD module together before beginning the threaded physical connection of the sleeve between them can be accomplished regardless of whether the sleeve is initially attached with the MWD module, or initially attached with the coupler.

Figure 19:
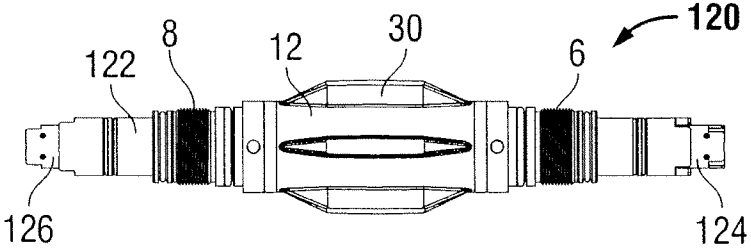
FIG. 19 is an alternative embodiment of a coupler having a fin housing, a first connector housing protruding on the right side from a shaft housing, and a second connector housing protruding on the left side from the shaft housing.
Figure 20A:
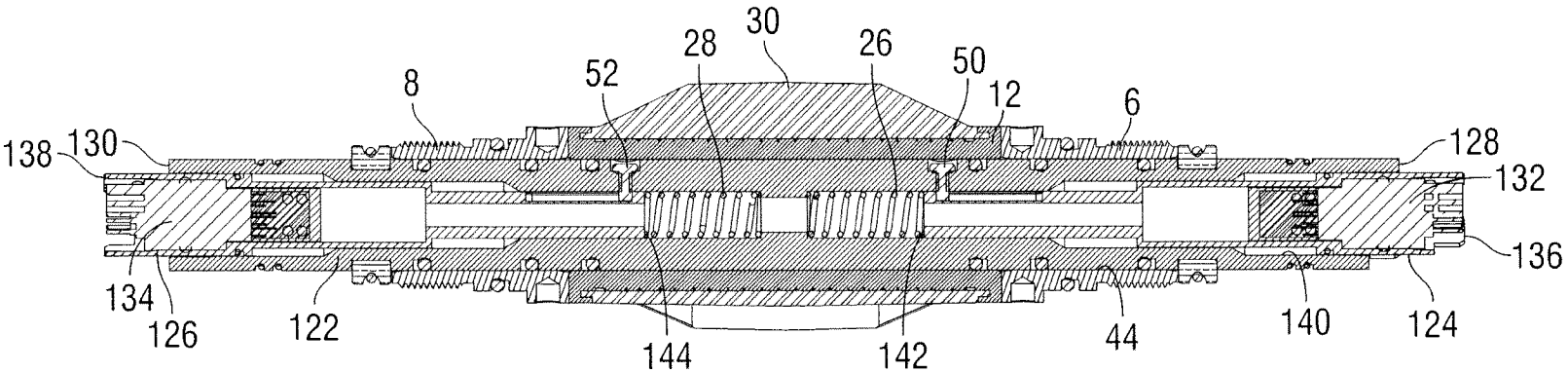
FIG. 20A is a section view along line 20A-20A of FIG. 20 with the shaft housing disposed in the thru bore of the fin housing, the first connector housing protruding on the right side from the shaft housing, the second connector housing protruding on the left side from the shaft housing, the unexposed ends of each connector housing each disposed with a spring in the shaft housing thru bore, and an electrical connector supported in each connector housing.

Turning to FIG. 19, alternative embodiment coupler 120 may have fin housing 12 with stabilizing fins 30, shaft housing 122, first connector housing 124, and second connector housing 126. It is also contemplated that there may be no fin housing 12 or fins 30. First connector housing 124 has a different key configuration at its first or exposed end 136 than second connector housing 126. Fin housing 12 has adjacent first threaded ring 6 and second threaded ring 8. The threaded rings 6, 8 each rotate independently of the fin housing 12 and the shaft housing 14. Sleeves from adjacent MWD modules may be threadedly attached with the threaded rings 6, 8. As shown in FIG. 20A, shaft housing 122 is disposed in thru bore 44 of fin housing 12. The shaft housing 122 can be rotated independently from the fin housing 12. First connector housing 124 is positioned in first end 128 of shaft housing 122 in the shaft housing thru bore 140. First electrical connector 132 is supported at the first or exposed end 136 of first connector housing 124. Second connector housing 126 is positioned in second end 130 of shaft housing 122 in the shaft housing thru bore 140. Second electrical connector 134 is supported at the first or exposed end 138 of second connector housing 126. First electrical connector 132 is in electrical communication with second electrical connector 134 through an electrical line, which is not shown for clarity.

First spring 26 is positioned with the second or unexposed end 142 of first connector housing 124. Second spring 28 is positioned with the second or unexposed end 144 of second connector housing 126. Both springs 26, 28 are in their uncompressed condition, in which condition the respective exposed ends 136, 138 of the respective connector housings 124, 126 and their respective electrical connectors 132, 134 protrude outwardly away from the respective ends 128, 130 of the shaft housing 122. Pins 50, 52 in respective slots 150, 182 of respective connector housings 124, 126 limit the movement of the connector housings 124, 126 as the springs 26, 28 become compressed or uncompressed. Other means of slidably disposing the first and second electrical connectors 132, 134 with the coupler 120 are contemplated.

Figure 21:
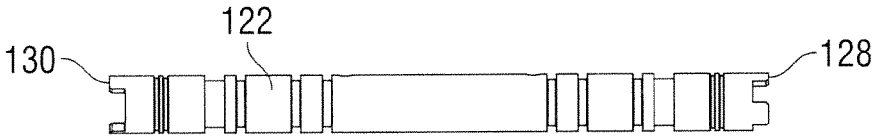
FIG. 21 is a side view of the shaft housing of FIG. 19 with different key configurations on each end.
Figure 21A:
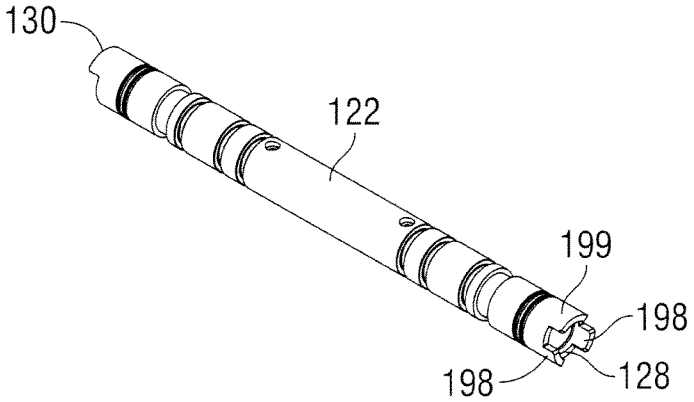
FIG. 21A is an isometric view of the shaft housing of FIG. 21 with a three leg key configuration on its first end.
Figure 21B:
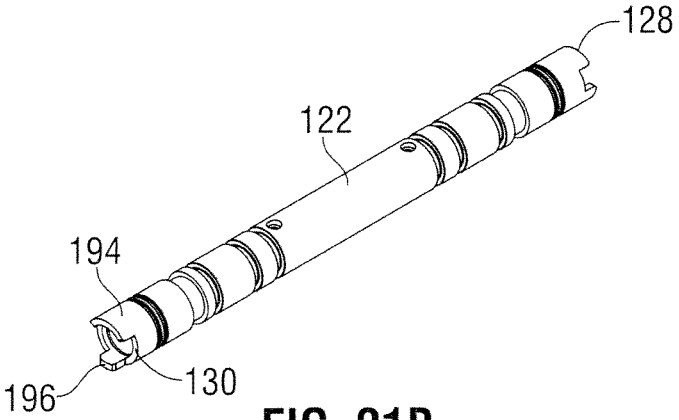
FIG. 21B is an isometric view of the shaft housing of FIG. 21 with a two leg key configuration on its second end.

As shown in FIGS. 21-21B, the first end 128 and second end 130 of shaft housing 122 have different key configurations. The shaft housing 122 may be used with the novel ends of MWD modules that will be discussed in detail below. Shaft housing first end 128 has a key configuration with two legs 198 having equal arc lengths as measured around the circumference of the shaft housing 122, and one leg 199 having a longer arc length than legs 198. Shaft housing second end 130 has a key configuration with one leg 194 having a longer arc length than the other leg 196.

Figure 22:
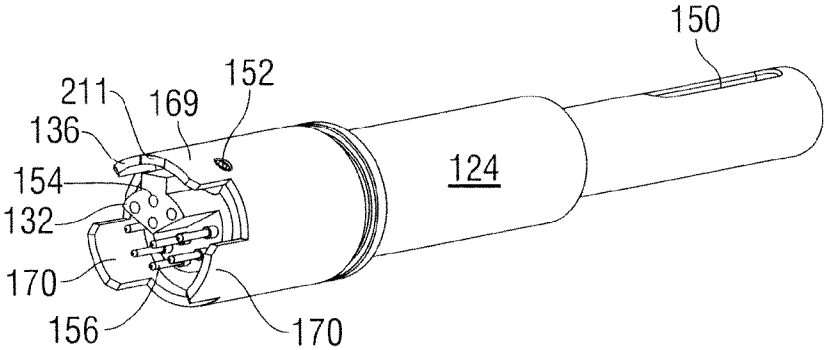
FIG. 22 is an isometric view of the first connector housing of FIG. 19 having a three leg key configuration on its first or exposed end and supporting a first electrical connector.
Figure 23:
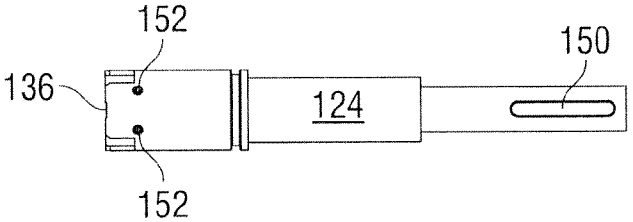
FIG. 23 is top view of the first connector housing of FIG. 22.

In FIGS. 22 and 23, first connector housing 124 has a key configuration at its exposed or first end 136 with two legs 170 having equal arc lengths as measured around the circumference of the first connector housing 124, and one leg 169 having a longer arc length than legs 170. The key configuration on first connector housing 124 is similar to the key configuration on first end 128 of shaft housing 122. First electrical connector 132 is supported in first connector housing 124, and has six pins 156 and four sockets 154 for mating with a corresponding electrical connector on the end of a MWD module. First electrical connector 132 is similar to electrical connector 23 in FIG. 5. First electrical connector 132 is supported against a shoulder in first connector housing 124, and may be held in place with screws in holes 152. It is contemplated that only one design of electrical connector may be compatible to be attached in the exposed end of first connector housing 124, which would be a different design than the electrical connector attached in second connector housing 126. Pin 50 in FIG. 20A may be disposed in slot 150. First electrical connector 132 is aligned vertically or at 90 degrees with notch 211.

Figure 24:
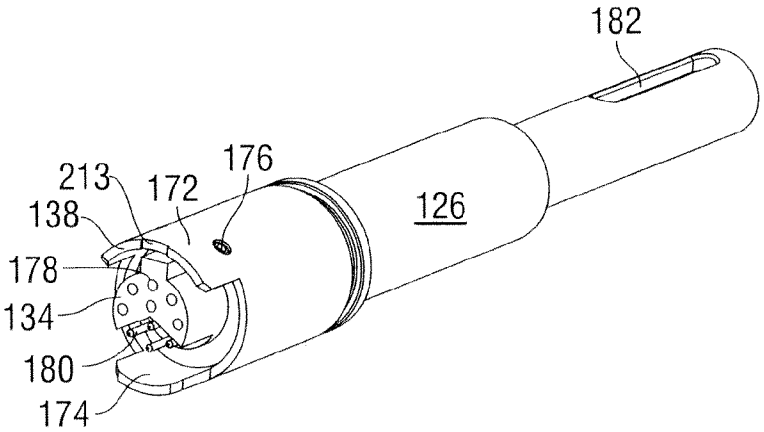
FIG. 24 is an isometric view of the second connector housing of FIG. 19 having a two leg key configuration on its first or exposed end and supporting a second electrical connector.
Figure 25:
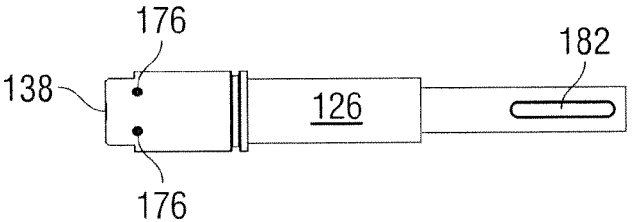
FIG. 25 is top view of the second connector housing of FIG. 24.

In FIGS. 24 and 25, second electrical connector 134 is supported in second connector housing 126, and has four electrical pins 180 and six sockets 178 for mating with a corresponding electrical connector on the end of a MWD module. Second electrical connector 134 is supported against a shoulder in second connector housing 126, and may be held in place with screws in holes 176. Second electrical connector 134 is similar in design to electrical connector 43 in FIG. 8. Pin 52 in FIG. 20A may be disposed in slot 182. Exposed end 138 of second connector housing 126 has a key configuration with a long leg 172 and a short leg 174 as measured in arc length around the circumference of second connector housing 126. The key configuration of second connector housing 126 is similar to the key configuration on second end 130 of shaft housing 122. It is contemplated that only one design of electrical connector may be compatible to be attached in the exposed end of second connector housing 126. Second electrical connector 134 is aligned vertically or at 90 degrees with notch 213.

Figure 26:
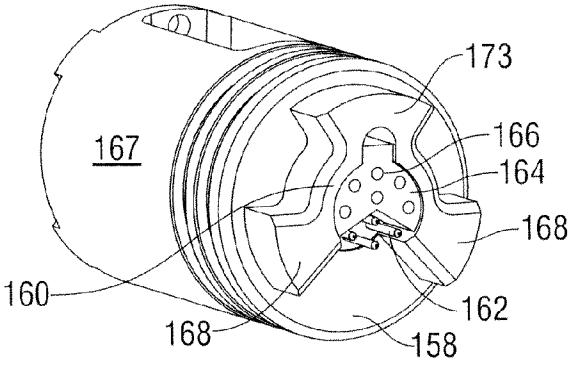
FIG. 26 is an isometric view of a MWD module end compatible with the first connector housing and first end of shaft housing on the right side of FIG. 19.
Figure 27:
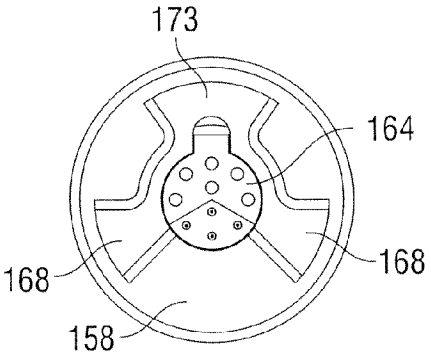
FIG. 27 is an end view of FIG. 26.

Turning to FIGS. 26 and 27, MWD module end 167 is compatible for use on a MWD module and has an end surface 158 with protrusion 160 and supports an electrical connector 164 with four pins 162 and six sockets 166. Protrusion 160 has two equal legs 168 as measured in arc length around the circumference of the module end and one longer leg 173 as measured in arc length. The body of the MWD module is not shown for clarity, and the sleeve that would shield the end 158 and electrical connector 164 is also not shown for clarity. The key configuration on the first end 128 of shaft housing 122 and the key configuration on the first end 136 of first connector housing 124 are compatible for mating with the module end 158 in FIGS. 26 and 27.

As can now be understood, the legs 168, 173 of protrusion 160 in combination with the three leg key configurations of shaft housing first end 128 and first connector housing 124 prevent first electrical connector electrical pins 156 from contacting MWD module electrical connector 164 during the electrical connection process unless the pins 156 are properly aligned with module sockets 166, in which case electrical pins 156 will move into sockets 166 and not become damaged. Electrical pins 162 of MWD module electrical connector 164 are similarly protected from damage during the connection process. If the alignment is not correct, then the legs 169, 170 of the key configuration of first connector housing 124 will contact the legs 168, 173 of module end 158 and prevent damage to the electrical connectors 132, 164. Similarly, if the alignment is not proper, then the legs 198, 199 at first end 128 of shaft housing 122 will contact legs 168, 173 of module end 158. When alignment is proper, the ends of legs 169, 170 of first connector housing 124 and the ends of legs 198, 199 of shaft housing 122 move past the ends of corresponding legs 168, 173 of module end 158. Other embodiments of key configurations on a shaft housing, a connector housing, and/or a MWD module end are also contemplated to prevent damage to electrical connectors. The MWD module end 167 may be used on a new MWD module, or may be retrofitted on to the end of a prior art MWD module. It is also more difficult for an operator to confuse the two ends of the coupler since the key configurations on the two ends differ.

Figure 28:
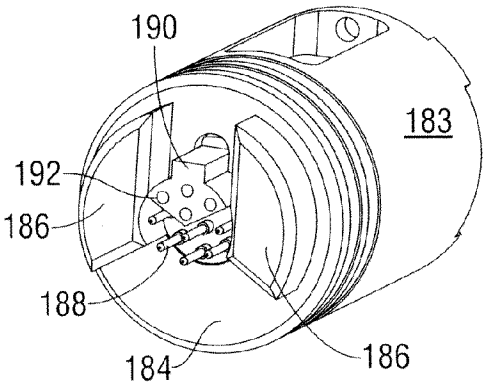
FIG. 28 is an isometric view of a MWD module end compatible with the second connector housing and second end of shaft housing on the left side of FIG. 19.
Figure 29:
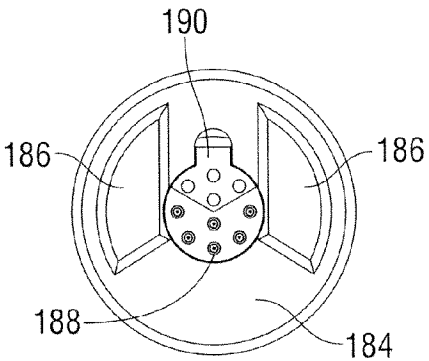
FIG. 29 is an end view of FIG. 28.

Turning to FIGS. 28 and 29, the MWD module end 183 is compatible for use with a MWD module and has an end surface 184 with two protrusions 186 and supports an electrical connector 190 having six pins 188 and four sockets 192. The body of the MWD module is not shown for clarity, and the sleeve that would shield the end 184 and electrical connector 190 is also not shown for clarity. The key configuration on the second end 130 of shaft housing 122 and the key configuration on the exposed end 138 of second connector housing 126 are compatible for mating with the module end 184 in FIGS. 28 and 29. The MWD module end 183 may be used on a new MWD module, or may be retrofitted on to a prior art MWD module.

As can now be understood, the two protrusions 186 in combination with the two leg key configuration of shaft housing second end 130 and second connector housing 126 prevent second electrical connector pins 180 from contacting module electrical connector 190 during the electrical connection process unless the pins 180 are properly aligned with module sockets 192, in which case pins 180 will move into sockets 192 and not become damaged. Pins 188 of MWD module electrical connector 190 are similarly protected from damage during the connection process. If the alignment is not proper, then the two legs 172, 174 of the key configuration of second connector housing 126 will contact the protrusions 186 of module end 183 and prevent damage to the electrical connectors 134, 190. Similarly, if the alignment is not proper, then the two legs 194, 196 of shaft housing 122 will contact protrusions 186 of module end 183. When alignment is proper, the ends of legs 172, 174 of second connector housing 126 and the ends of legs of shaft housing 122 move past the ends of corresponding protrusions 186 of module end 184.

Other embodiments of key configurations on a shaft housing, a connector housing, and/or a MWD module end are also contemplated to prevent damage to electrical connectors. It should also be understood that the first electrical connector 132 having six electrical pins 156 and the second electrical connector 134 having four electrical pins 180 may be reversed on the coupler 120, and that the corresponding compatible MWD module ends 167, 183 may be reversed. It is also contemplated that other types and sizes of electrical connectors, such as having different numbers of electrical pins besides four or six, may be used on the coupler 120 that are compatible with electrical connectors on the MWD module ends.

As can now be understood, by having difference key configurations on the first end of shaft housing 122 and the second end of shaft housing 122, the two ends cannot easily be mistakenly reversed during connection with MWD modules. Similarly, by having difference key configurations on the first connector housing 124 and the second connector housing 126, the two ends cannot easily be mistakenly reversed during connection with MWD modules. If the ends of the connector housing or shaft housing are mistakenly reversed, they will not connect with the MWD module end with which they are attempted to be connected, and damage to the electrical connectors will be prevented.

Turning to FIGS. 30-30C, coupler 120 of FIG. 19 is positioned between first MWD module 202 and second MWD module 206, which modules are both only shown partially for clarity. First MWD module 202 has module end 167 shown in FIGS. 26-27, and second MWD module 206 has module end 183 shown in FIGS. 28-29. Since first connector housing 124 and first electrical connector 132 protrude from the first end of shaft housing 122, first electrical connector 132 may be aligned and connected with corresponding first module electrical connector 164, before first module sleeve 208 is threadedly attached with threads 203 to first threaded ring 6 on coupler housing 12. This advantageously allows the electrical connection to be made prior to the threaded connection of the sleeve to minimize damage to the electrical pins on both the electrical connectors 132, 164. First spring 26 and second spring 28 are uncompressed.

Similarly, since second connector housing 126 and second electrical connector 134 protrude from the second end of shaft housing 122, second electrical connector 134 may be aligned and connected with corresponding second module electrical connector 190, before second module sleeve 210 is threadedly attached with threads 205 to second threaded ring 8 on coupler housing 12. This also advantageously allows the electrical connection to be made prior to the threaded connection of the sleeve to minimize damage to the electrical pins on both the electrical connectors 134, 190.

Figure 31A:
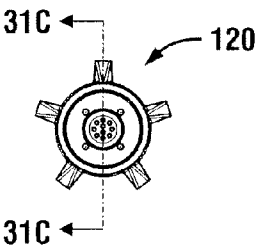
FIG. 31A is an end view of the coupler and MWD module on the left side of FIG. 31.
Figure 31:
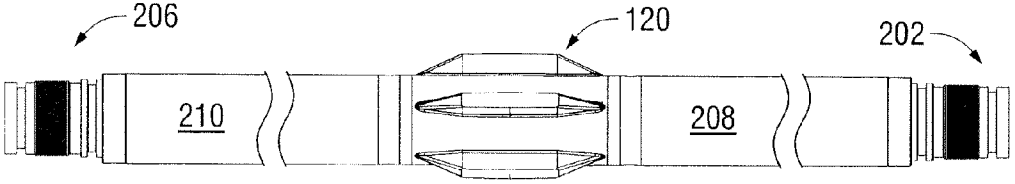
FIG. 31 is a side view of the coupler of FIG. 30 with the sleeves having been threadedly attached with the coupler and the connection with the two MWD modules completed.
Figure 31B:
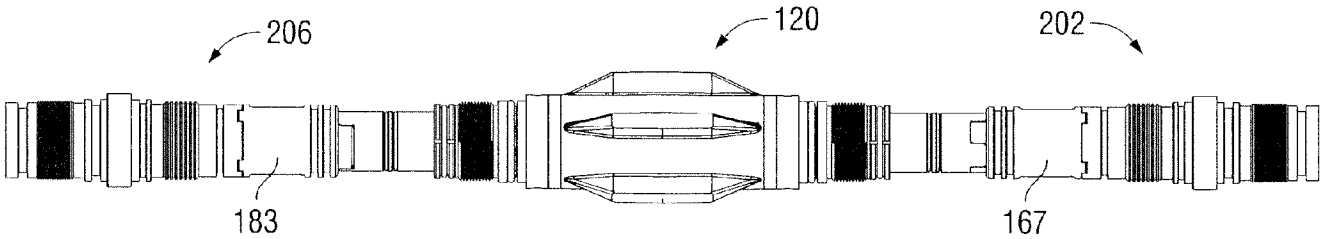
FIG. 31B is a side view of the coupler of FIG. 31 in its condition with the sleeves threadedly attached with the coupler, but with the sleeves removed for clarity to show the keyed connection between the first end of the shaft housing and the MWD module on the right side, and the keyed connection between the second end of the shaft housing and the MWD module on the left side.
Figure 31C:
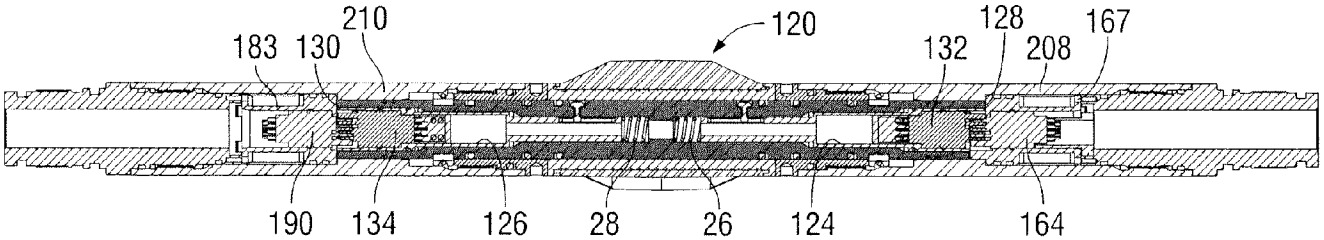
FIG. 31C is a cross-sectional view along line 31C-31C of FIG. 31A showing the sleeves of the MWD modules fully threadedly attached with the coupler, with the springs in their compressed condition, the electrical connection between the coupler and the MWD modules having been made, and the electrical connectors of the coupler having moved inwardly to be flush with the respective ends of the shaft housing.

In FIGS. 31-31C, coupler 120, first MWD module 202, and second MWD module 206 are in their fully coupled condition. First module sleeve 208 and second module sleeve 210 have been fully threadedly attached with coupler 120. First spring 26 and second spring 28 are in their compressed condition or second positions. During the connection of the sleeves 208, 210 with the coupler 120, first connector housing 124 and second connector housing 126 moved inwardly from their positions in FIG. 30C, so that first electrical connector 132 is flush with first end 128 of shaft housing 122, and second electrical connector 134 is flush with second end 130 of shaft housing 122.

As can now be understood, the embodiments advantageously allow faster building of MWD tool strings. The embodiments prevent damage to the MWD tools, which results in higher tool utilization. The embodiments make training of MWD operators easier.

It is contemplated that the couplers 10, 120 of FIGS. 9 and 19, respectively, may be used with other downhole tools besides MWD modules, including, but not limited to, wireline tools, production logging tools, and tools that take measurements while drilling, such as LWD modules and SWD modules. It is contemplated that the MWD module ends, such as MWD module end 167 in FIG. 26, may be used on any downhole tool, not just MWD tools. It is also contemplated that the movable or slidable component of the coupler, such as first connector housing 124 or second connector housing 126 of coupler 120 in FIG. 20A, may be used on the downhole tool instead of the coupler, and that the coupler may have the static MWD module end, such as MWD module end 167 in FIG. 26.

Although the embodiments are shown with electrical connectors having certain configurations and numbers of electrical pins and sockets, other configurations and pins and sockets are also contemplated for all embodiments. Additionally, although certain key configurations are shown in certain embodiments, it is also contemplated that other key configurations could be used, such as four leg configurations or the use of dowel pins. Although the embodiments are shown in use with MWD modules, it is also contemplated that the embodiments may be used in logging while drilling, wireline surveying, and other applications.

The foregoing disclosure and description of the invention are illustrative and explanatory thereof, and various changes in the details of the illustrated apparatus and system, and the construction and the method of operation may be made without departing from the spirit of the invention.

What is claimed is:

1. A coupler for coupling downhole tools, comprising:

a shaft housing having a first side and a second side, wherein the first side has a first end and the second side has a second end;

a first electrical connector slidingly disposed in the first side of the shaft housing;

a second electrical connector sliding disposed in the second side of the shaft housing; and a first threaded ring disposed on an outside of the first side of the shaft housing, wherein the first threaded ring is configured to rotate independently of the shaft housing; and configured to be received by an interior surface of a sleeve of a first downhole tool, and wherein the first threaded ring is configured to control the mating of the first electrical connector with a corresponding electrical connector of the first downhole tool, and wherein the first side has a first shaft housing key configuration configured to mate with a key configuration on the first downhole tool and the second side has a second shaft housing key configuration configured to mate with a key configuration on the second downhole tool, wherein the each of the key configurations extends further outward than their corresponding electrical connectors.

2. The coupler of claim 1, wherein said first connector shaft housing key configuration is configured to prevent an electrical pin on said first electrical connector from contacting a downhole tool unless said electrical pin is aligned with a matching socket of a downhole tool.

3. The coupler of claim 1, wherein said first shaft housing key configuration is the same as said second shaft housing key configuration.

4. The coupler of claim 1, wherein said first connector housing key configuration is the same as said second connector housing key configuration.

5. The coupler of claim 1 further comprising:

a first connector housing slidingly disposed in said shaft housing and supporting said first electrical connector; and a second connector housing slidingly disposed in said shaft housing and supporting said second electrical connector.

6. The coupler of claim 5, wherein at least a portion of each connector housing is disposed in said shaft housing with a spring further comprising:

a first spring disposed inside the first side of the shaft housing and in mechanical communication with the first electrical connector housing; and a second spring disposed inside the second side of the shaft housing and in mechanical communication with the second electrical connector housing.

7. The coupler of claim 1, wherein the coupler further comprises:

a second threaded ring disposed on an outside of the second side of the shaft housing, wherein the first threaded ring is configured to rotate independently of the shaft housing and the first threaded ring, and wherein the second downhole tool includes an interior threaded surface configured to receive the second threaded ring.

8. The coupler of claim 1, wherein said downhole tools are MWD modules.

* * * * *